United States Patent [19]

Warthen

[11] 4,363,432

[45] Dec. 14, 1982

[54] CIGARETTE LIGHTER SUPPORT

[76] Inventor: William H. Warthen, 5050 W. Harvard, Clarkston, Mich. 48016

[21] Appl. No.: 207,978

[22] Filed: Nov. 18, 1980

[51] Int. Cl.[3] ..... A45F 5/02

[52] U.S. Cl. ..... 224/247; 24/3L; 206/87; 224/252

[58] Field of Search ..... 224/247, 248, 251, 252, 224/253, 269; 206/85, 87–89; 24/3 B, 3 C, 3 D, 3 E, 3 F, 3 J, 3 L

[56] References Cited

U.S. PATENT DOCUMENTS

| | | | |
|---|---|---|---|
| D. 203,101 | 12/1965 | Holder | 224/252 X |
| 1,403,707 | 1/1922 | Quarnstrom | 224/247 X |
| 1,464,659 | 8/1923 | Keely . | |
| 1,611,275 | 12/1926 | Lewis | 224/247 X |
| 1,846,275 | 2/1932 | Palanjian | 206/87 |
| 1,913,142 | 6/1933 | Ondriceil . | |
| 2,536,725 | 1/1951 | Cleveland . | |
| 2,769,219 | 11/1956 | Elkavich | 206/87 X |
| 3,157,927 | 11/1964 | Roden | 224/248 X |
| 3,326,433 | 6/1967 | Koch . | |
| 3,497,118 | 2/1970 | Najjar | 224/252 X |
| 4,176,773 | 12/1979 | Wilkinson | 224/250 X |

FOREIGN PATENT DOCUMENTS

| | | | |
|---|---|---|---|
| 940610 | 10/1963 | United Kingdom | 206/87 |

*Primary Examiner*—William Price
*Assistant Examiner*—Gary E. Elkins
*Attorney, Agent, or Firm*—Basile, Weintraub & Hanlon

[57] ABSTRACT

A cigarette lighter support for supporting a cigarette lighter to an article of apparel is disclosed. The support includes a clip for attaching the support to the belt or a pocket of the user. The support comprises a vertical wall abutting the lighter, a bottom wall integral with the vertical wall engageable with the lighter bottom, a pair of opposed arcuate arms extending transversly from the vertical wall curving forward than inward to snugly embrace the lighter. The lighter is insertable between the arcuate arms with the lighter bottom resting on the bottom wall.

2 Claims, 5 Drawing Figures

CIGARETTE LIGHTER SUPPORT

BACKGROUND OF THE INVENTION

I. Field of the Invention

The present invention generally relates to the field of supports, and in particular, the present invention is concerned with cigarette lighter supports having a clip for attaching these supports to an article of apparel, such as a belt or a pocket opening.

II. Description of the Prior Art

Supports releaseably attachable to an article of apparel such as a belt or shirt pocket of the user for carrying useful articles are known. Examples of supports of this type in the prior art are disclosed in U.S. Pat. No. De. 203,101; U.S. Pat. Nos. 1,464,659; 1,516,848; 1,913,142; 3,157,927; 3,326,433; 2,536,725; and 4,176,773. These patents are relevant to the Applicant's invention in that they represent the closest prior art for supporting articles with the support attached to an article of apparel.

III. Prior Art Statement

The aforementioned prior art, in the opinion of the Applicant and the Applicant's Attorney, represents the closest prior art of which the Applicant and his Attorney are aware.

SUMMARY OF THE INVENTION

The present invention, which will be described in greater detail hereinafter, comprises a cigarette lighter support for securing the lighter to an article of apparel such as a belt or pocket opening of the user. The support comprises a vertical wall abutting the lighter with a bottom wall projecting from the lower end thereof to support the lighter bottom. A pair of opposed arcuate arms extend transversely from the vertical wall and are integral there with, with the arms curving forward then inward to snugly embrace or encircle the lighter. A garment engaging clip is formed from an upward extending portion of the vertical wall which extension curves arcuately rearward then downward and inward toward the lower portion of the vertical wall. The lower end of the clip terminates proximate the vertical wall. The lighter is releaseably insertable between the arcuate arms with the bottom wall defining a position for the lighter bottom wall. In a preferred embodiment a projecting flange integral with one of the arms is provided to allow the thumb of the user to press downward on the flange while an upward pressure is exerted on the lighter bottom to extract the lighter from the support using only one hand.

It is therefore a primary object of the present invention to provide a new and improved lighter support.

It is a further object of the present invention to provide such a lighter support that is releaseably attachable to an article of apparel.

It is yet another object of the present invention to provide such a lighter support with a clip for releaseably grasping a pocket opening or a belt of the user.

It is a further object of the present invention to form such a clip from an upward extension of a wall of the lighter.

It is yet another object of the present invention to provide the support with a bottom wall extension so that a downward force can be exerted on the support as the lighter is removed from the support.

It is yet a further object of the present invention to provide the support with a flange attached to an arm of the support that is engageable by the thumb of the user so that the bottom of the lighter may be pushed up with the user's forefinger while the thumb exerts a downward force on the support to remove the lighter from the support using one hand.

Further objects, advantages, and applications of the present invention will become apparent to those skilled in the art of cigarette lighter supports when the accompanying description of one example of the best mode contemplated for practicing the invention is read in conjunction with the accompanying drawing.

BRIEF DESCRIPTION OF THE DRAWING

In the drawing like numbers refer to like parts throughout the several views and wherein.

DESCRIPTION OF THE PREFERRED EMBODIMENT

Figure 1:
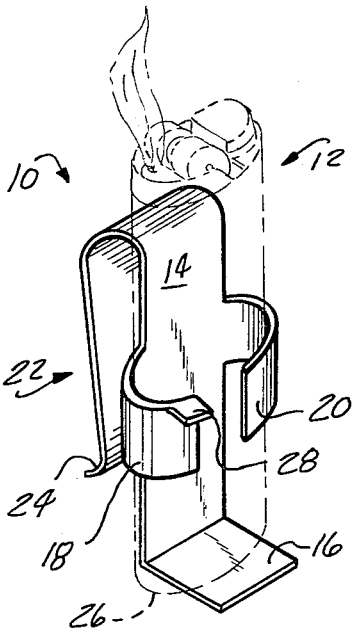
FIG. 1 illustrates a perspective view of a preferred embodiment for the cigarette lighter support of the present invention.

Referring now to the drawing, there is illustrated in FIG. 1 one example of the present invention in the form of a cigarette lighter support 10. The cigarette lighter support 10 is adapted to support a cigarette lighter 12 to a garment or an article of apparel in a manner which will be described subsequently. The cigarette lighter support 10 comprises a vertical wall 14 abutting the cigarette lighter 12 and a bottom wall 16 integral with the vertical wall 15 extending horizontally therefrom to support the bottom of the lighter 12. A pair of opposed arcuate arms 18, 20 extend transversely from and are integral with the vertical wall 14, said arms 18, 20 curving forward then inward to snugly embrace the lighter 12.

A garment engaging clip 22 is formed from an upward extension of the vertical wall 14 which curves arcuately rearward then downward then downward and inward toward the vertical wall and terminates proximate the vertical wall. The clip 22 is adapted to releaseably grasp an article of apparel such as a pocket opening or a belt between the clip 22 and the vertical wall 14. Preferably the clip 22 has a bottom edge 24 that curves gently away from the vertical wall 14 to aid in placing the clip over a pocket opening or a belt. The lighter 12 is insertable between the arcuate arms 18, 20 with the bottom of the lighter resting on the bottom wall 16.

As shown in FIG. 1 in the drawing, the bottom wall 16 projects horizontally past the lighter 12 a distance to provide a place for the user to place his thumb or finger to hold the support 10 in engagement with the article of apparel as he lifts upward to remove the lighter from the support. In a preferred embodiment the lighter 12 projects a distance above an upper portion of the vertical wall 14 to allow the grasping of the lighter 12 between thumb and forefinger to remove it from the support. The vertical wall and the bottom wall are made narrower than the lighter 12 to provide an overhang 26 for the lighter bottom. This overhang allows the user to press downward on the bottom wall 16 with his finger while urging the lighter 12 upward with pressure from the thumb on the overhang 26 to slide the lighter 12 upward between the arms 18, 20.

The cigarette lighter support 10 is also provided with a forward extending flange 28 integral with the arm 18 and extending forward therefrom a distance. The user may utilize the flange 28 to remove the lighter 12 from the support 10 using only one hand by pressing downward on the flange 28 with his thumb while at the same time engaging the overhang 26 with his forefinger gently urging the cigarette lighter 12 upward with his forefinger until the lighter is removed from the support.

Figure 2:
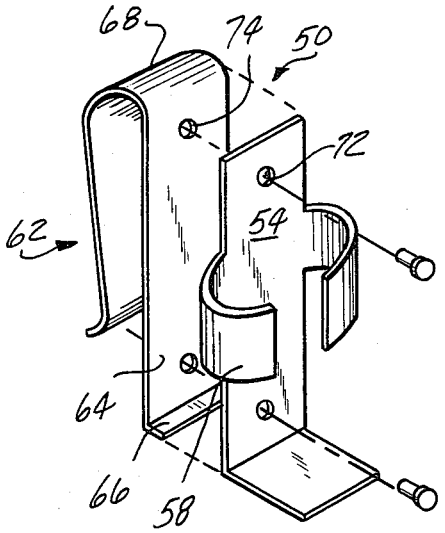
FIG. 2 illustrates an exploded perspective view of a second embodiment of a cigarette lighter support of the present invention.
Figure 3:
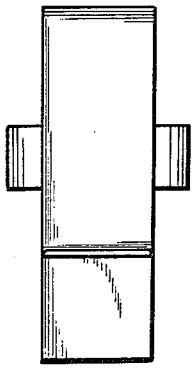
FIG. 3 illustrates a rear view of the cigarette lighter support of FIG. 1.
Figure 4:
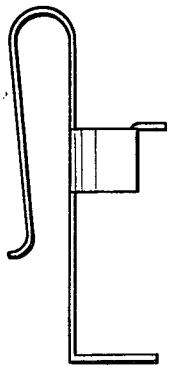
FIG. 4 illustrates a side view of the cigarette lighter support of FIG. 1.
Figure 5:
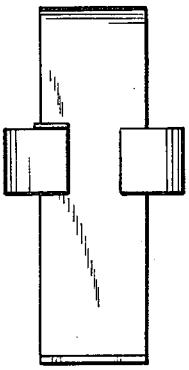
FIG. 5 illustrates a front view of the cigarette lighter support of FIG. 1.

Referring now to FIG. 2 of the drawing, there is illustrated at 50 an alternate embodiment of the cigarette lighter support of the present invention. The alternate embodiment 50 comprises an upright wall 54 with a lower wall 56 integral with the upright wall 54 and extending horizontally therefrom. A pair of opposed support walls 58, 60 are integral with the upright wall 54 and extend transversely therefrom curving forward and then inward in an arcuate manner to snugly grasp the cigarette lighter 12.

The alternate lighter support 50 further includes a clip 62 comprising a clip vertical wall 64 abutting the upright wall 54 and extending there along, and a clip horizontal extension 66 at a lower end of the clip vertical wall 64 extending horizontally forward a distance to abut the lower wall 56. A clip upper portion 68 curves arcuately rearward then downward then downward and inward terminating proximate the clip vertical wall 64 to releaseably grasp an article of apparel such as a belt or a pocket opening. The clip 62 is preferably joined to the upright wall 54 by a pair of fasteners 70, such as rivets entering a pair of aligned apertures 72, 74 to join the clip vertical wall 64 to the upright wall 54. A cigarette lighter support made in the manner illustrated at 50 allows the use of different material in the manufacture of the support. For example, lightweight inexpensive injection molded plastic can be used for forming the upright wall 54, the lower wall 56, and the pair of opposed support walls 58, 60; while the clip 62 can be made from steel having excellent spring properties for grasping the article of apparel to which the cigarette lighter support is attached. It is obvious to the skilled artesian that the clip 62 may alternately be joined to the upright wall 54 utilizing an adhesive such as apoxy resin, or using fasteners other than rivets.

It can thus be seen that the present invention has provided a new and improved cigarette lighter support that can be releaseably attached to a garment of the user that is economically to make and convenient to use.

It should be understood by those skilled in the art of cigarette lighter supports that other forms of the Applicant's invention may be had, all coming within the spirit of the invention and the scope of appended claims.

Having thus described my invention what I claim is:

1. A cigarette lighter support for securing the lighter to an article of apparel comprising:

a vertical wall abutting the lighter;

a bottom wall to support the lighter bottom integral with and extending forward from the vertical wall, said bottom wall narrower than said lighter bottom allowing said lighter bottom to project beyond said bottom wall a pair of opposed arcuate arms extending transversely from and integral with the vertical wall, said arms curving forward then inward to snugly embrace the lighter;

a horizontal planar flange integral with and extending forward from one of said arms;

a garment engaging clip formed from an upward extension of the vertical wall curving arcuately rearward then downward then downward and inward toward the vertical wall, terminating proximate the vertical wall;

the lighter snugly insertable between the arcuate arms with the lighter bottom resting on the bottom wall; and wherein the lighter is removable from the support with one hand with the user's thumb pressing downward on said horizontal flange and the user's forefinger pressing upward on the lighter bottom.

2. A cigarette lighter support for securing the lighter to an article of clothing comprising:

a vertical wall abutting the lighter;

a bottom wall to support the lighter bottom integral with and extending forward from the vertical wall;

a pair of opposed arcuate arms extending transverse from and integral with said vertical wall, said arms curving forward then inward to snugly embrace the lighter;

a garment engaging clip comprising a clip front wall abutting and complimentary to said vertical wall;

an upper end of said clip front wall curving away from said vertical wall arcuately rearward then downward and inward extending downward to a lower portion of said vertical wall for grasping articles of apparel;

a lower end of said clip front wall extending forward to abut said bottom wall; means for joining said clip to said vertical wall comprising:

at least one aperture formed in said vertical wall aligned with an aperture formed in said clip, and fastening means engaging the aligned apertures to secure said clip to said vertical wall; and wherein said lower end supports and strengthens said bottom wall.

* * * * *